US012723410B2

(12) United States Patent
Imvriotis

(10) Patent No.: US 12,723,410 B2
(45) Date of Patent: Sep. 1, 2026

(54) MODULAR STAIRCASE

(71) Applicant: NxGen Homes Pty Ltd, Botany (AU)

(72) Inventor: Alexander Imvriotis, Maroubra South (AU)

(73) Assignee: NxGen Homes Pty Ltd, Botany (AU)

( * ) Notice: Subject to any disclaimer, the term of this patent is extended or adjusted under 35 U.S.C. 154(b) by 124 days.

(21) Appl. No.: 18/648,287

(22) Filed: Apr. 26, 2024

(65) Prior Publication Data

US 2024/0279936 A1 Aug. 22, 2024

Related U.S. Application Data

(63) Continuation of application No. PCT/AU2022/051304, filed on Oct. 28, 2022.

(30) Foreign Application Priority Data

Oct. 28, 2021 (AU) ..... 2021903457

(51) Int. Cl.
*E04F 11/025* (2006.01)
*E04F 21/26* (2006.01)

(52) U.S. Cl.
CPC ..... *E04F 11/025* (2013.01); *E04F 21/26* (2013.01)

(58) Field of Classification Search
CPC ..... E04F 11/025; E04F 11/035; E04F 11/09; E04F 21/26

(Continued)

(56) References Cited

U.S. PATENT DOCUMENTS 2,818,945 A * 1/1958 Holzer ..... E04F 11/025 52/191
3,310,132 A * 3/1967 Rolland ..... E04F 11/028 182/189

(Continued)

FOREIGN PATENT DOCUMENTS

AU 2020100510 A4 * 5/2020 ..... E04F 11/1041
CA 1315068 C 3/1993

(Continued)

OTHER PUBLICATIONS

Extended European Search Report dated Jun. 10, 2025 in EP Patent Application No. 22884802.4. 9 pages.

(Continued)

*Primary Examiner* — Paola Agudelo
(74) *Attorney, Agent, or Firm* — Kilpatrick Townsend & Stockton LLP

(57) ABSTRACT

Disclosed is a modular staircase suitable for use in a structure. The staircase comprises at least one stringer having an elongate axis. The stringer is configured for extending between a first floor of the structure and a second floor of the structure. The stringer has a box-section profile and at least two flanges projecting from a first wall of the stringer profile. The staircase further comprises at least one spigot configured for mounting with the at least two flanges such that an axis of the spigot can extend at an angle with respect to the stringer elongate axis. The staircase further comprises at least one tread support for coupling to the stringer via the at least one spigot. When the angle of the spigot axis is adjusted relative to the stringer elongate axis, the tread support is able to be orientated at an angle relative to the stringer in-use.

16 Claims, 13 Drawing Sheets

(58) Field of Classification Search
USPC ..... 52/182
See application file for complete search history.

(56) References Cited

U.S. PATENT DOCUMENTS 3,707,814 A * 1/1973 Seegers ..... E04F 11/02 52/185
3,986,579 A * 10/1976 Howard ..... E04F 11/025 182/189
4,015,687 A * 4/1977 Dean ..... E04F 11/025 248/248
4,106,591 A * 8/1978 Cohen ..... E04F 11/028 182/100
4,819,391 A * 4/1989 Tassin ..... E04F 11/025 52/715
5,010,699 A * 4/1991 Maiuccoro ..... E04F 11/025 52/169.8
5,086,595 A * 2/1992 Maiuccoro ..... E04F 11/00 52/191
6,088,977 A * 7/2000 Lawrence ..... E04F 11/1041 52/190
6,125,598 A * 10/2000 Lanphier ..... E04F 11/181 52/832
7,617,652 B1 * 11/2009 Flatmoe ..... E04F 11/112 52/263
2024/0279936 A1 * 8/2024 Imvriotis ..... E04F 21/26

FOREIGN PATENT DOCUMENTS

JP 2005315031 A 11/2005
WO 2018210618 A1 11/2018

OTHER PUBLICATIONS

International Search Report and Written Opinion of the International Searching Authority mailed Jan. 9, 2023 in International Patent Application No. PCT/AU2022/051304. 10 pages.
International Preliminary Report on Patentability mailed Jun. 6, 2023 in International Patent Application No. PCT/AU2022/051304. 100 pages.

* cited by examiner

FIG. 4A
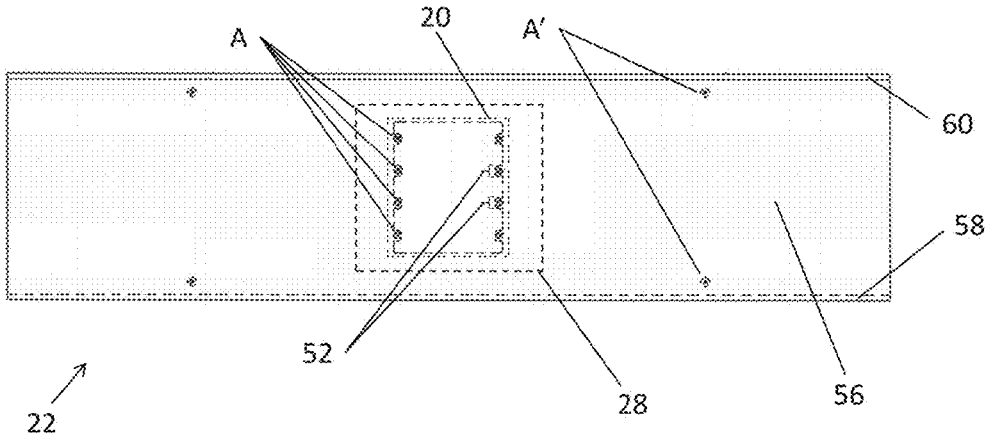
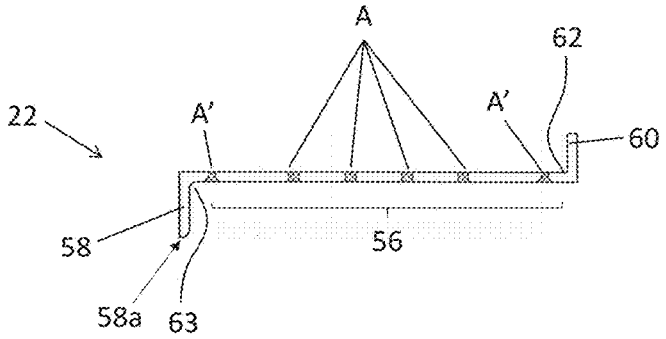
FIG. 4B
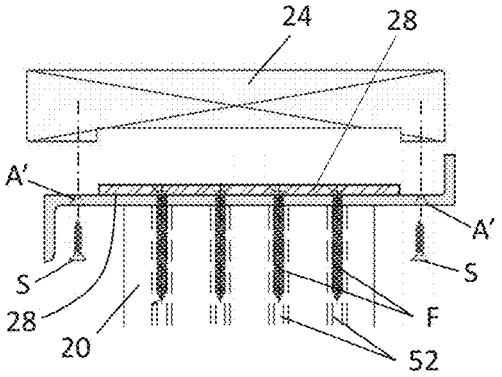
FIG. 4C

FIG. 5A
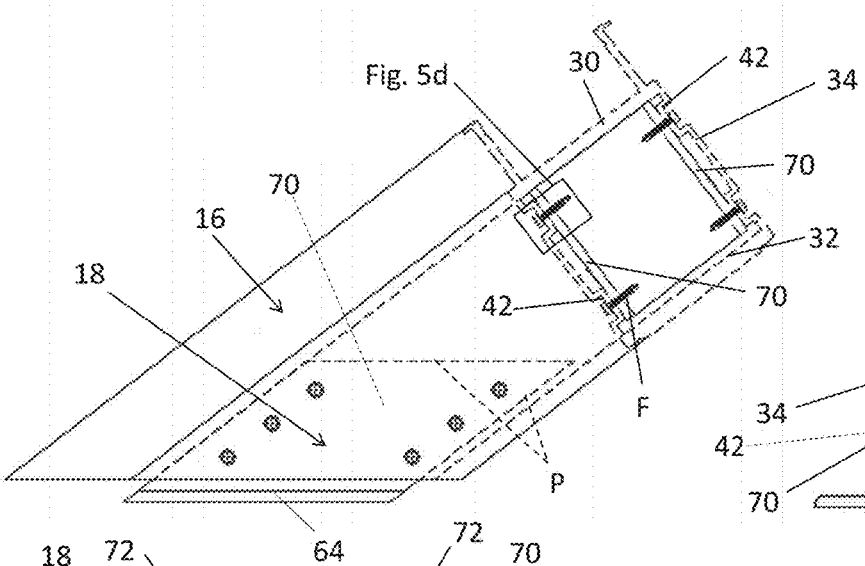
FIG. 5B
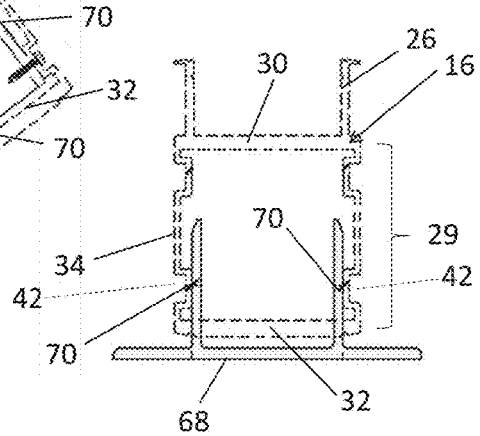
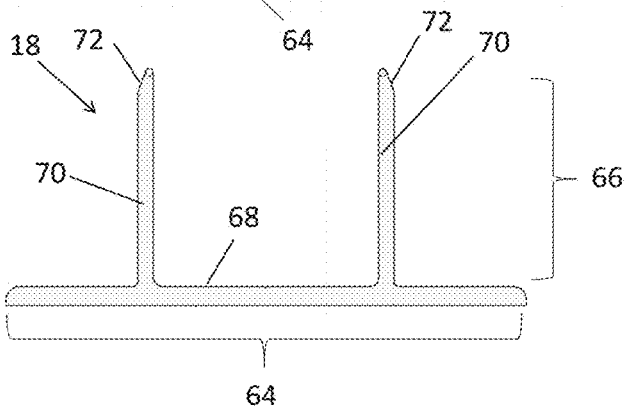
FIG. 5C
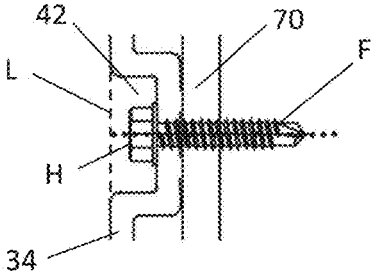
FIG. 5D

MODULAR STAIRCASE

CROSS-REFERENCES TO RELATED APPLICATIONS

This application is a continuation application of International Patent Application No. PCT/AU2022/051304 entitled "MODULAR STAIRCASE," filed on Oct. 28, 2022, which claims priority to Australian Patent Application No. 2021903457, filed on Oct. 28, 2021, each of which are herein incorporated by reference in their entirety for all purposes.

BACKGROUND OF THE INVENTION

Floating staircases are so-called because the tread members (i.e. steps) upon which a user treads or stands can appear to be 'floating in space'. The staircase may extend between two floors of a building, or between a floor and a landing, or between two landings, etc. Further, each tread member (step) is discrete and is spaced out in the staircase from each other tread member.

In one form, the tread members (or steps) can each be supported by a centrally arranged spine (e.g. elongate stringer/beam). Further, each tread member is supported in a spaced relation above the spine, to be mounted at a location that is intermediate its ends, by a flange/web/spigot that connects the tread member to the spine. The spine can be straight, curved, etc.

In another form, the tread members (or steps) can each be supported in a cantilevered arrangement. In this arrangement, the spine (e.g. stringer/beam) can be offset to one side of all of the tread members, with an end of each tread member being mounted to the spine (e.g. via a mounting/bracket) and supported in a spaced cantilevered relation along the spine. Alternatively, instead of a spine, an end of each tread member can be mounted to extend out from a wall frame (or the like). Again, the spine or wall frame, etc. can be straight, curved, etc.

Usually, each floating staircase is a bespoke design that is created as a 'one-off' for a given construction project/site. In this regard, the particularities of a given site are taken into account (i.e. surveyed, measured, designed, etc.) and then the floating staircase is accordingly constructed offsite, and thereafter is transported to and installed at the given site. Further, usually any mismatch/misfit needs to be addressed/rectified on site.

It is to be understood that a reference herein to the prior art does not constitute an admission that the prior art forms a part of the common general knowledge in the art, in Australia or in any other country.

BRIEF SUMMARY OF THE INVENTION

Disclosed herein is a modular staircase that is suitable for use in a structure (e.g. a building or similar). The modular staircase may be used to construct a floating staircase (e.g. with a single stringer or spine, and with tread members (steps) spaced out along the stringer/spine). In such a floating staircase, the treads may be centrally- or cantilever-mounted along the stringer/spine. The modular staircase may also comprise two spaced (e.g. parallel) stringers (spines) with treads spanning between the stringers, such that a conventional-form staircase can be constructed. The modular staircase can be configured such that it can be measured, designed, shaped/fashioned and installed on-site.

The modular staircase can comprise at least one stringer (e.g. one, or two spaced stringers) that each have an elongate axis. The or each stringer can be configured to form a spine (or 'backbone') of the staircase. The stringer can be configured for extending between a first floor of the structure and a second floor of the structure. Herein, it should be understood that reference to a 'floor' can include within its scope an intermediate landing or the like. In this regard, the stringer may extend between a given floor and a landing, or between two landings, etc. The or each stringer may also be straight, curved, etc., depending on the required/desired staircase design.

The stringer can be provided with a box-section profile, typically a structural profile that can accommodate the various loadings that are applied to a staircase in use. At least two flanges can project from a first (e.g. in-use upper) wall of the stringer profile. The at least two flanges may extend for a length of the stringer profile.

The modular staircase can also comprise at least one spigot (typically it comprises multiple spaced spigots). Each spigot can be configured for mounting between the at least two flanges. When mounted, an axis of the spigot can extend at an angle with respect to the stringer elongate axis. For example, the spigot axis may, in-use, be arranged to extend vertically. Further, each spigot may be configured for being adjusted with respect to the at least two flanges, for example, by being cut/shaped-typically on site (e.g. 'cut-to-measure'). The ability to adjust each spigot on site contributes to the modularity of the staircase. For example, once a 'kit' of staircase components has been supplied to a given site, all other aspects of the modular staircase (e.g. measuring, designing, shaping/fashioning, installation, finishing, etc.) can take place on site.

The modular staircase can further comprise at least one tread support (typically it comprises multiple spaced tread supports). Each tread support can be coupled to the stringer via the at least one spigot (i.e. via respective spigot(s)). In use, when the angle of the spigot axis is adjusted relative to the stringer elongate axis, the tread support can be orientated at an angle relative to the stringer in-use. For example, the tread support may be orientated, in-use, to be horizontal. In this orientation, the tread support can provide a suitable orientation for the positioning thereon of a tread member (i.e. step).

For example, the stringer can be positioned to extend at a suitable/desired angle with respect to each of the first and second floors (or landing(s)) of the structure. Regardless of the stringer angle, the angle of the spigot axis may be adjusted relative to the stringer elongate axis. As set forth above, this adjustment can take place on site, during construction of the modular staircase. At a desired angle of the spigot axis, the spigot may be fixedly mounted with the at least two flanges (i.e. to fix its angle with respect to the stringer axis). This desired angle can, in turn, correspond to a desired orientation (e.g. horizontal) for the tread support (step).

To achieve a desired angle of the spigot axis, an end of the at least one spigot that is mounted at the at least two flanges may be configured to be cut at an angle (e.g. by a suitable tool on site). Thus, when the spigot is mounted at the stringer, the angle of the cut may be generally parallel to the stringer elongate axis. For example, an underside edge of the cut end may interface with an in-use upper wall of the stringer profile to thereby 'set' the angle of the spigot axis. For example, the angle of cut at the end of the spigot may be such that the spigot axis extends generally vertically (i.e.

to set the spigot to extend vertically in use). Thereafter, the spigot may be fastened to the stringer flanges.

In some embodiments, the at least one spigot may be configured for mounting between the at least two flanges. For example, the spigot may be fastened between the flanges by respective fasteners that extend through the flanges and through corresponding walls of the spigot. In other words, once each spigot is at its correct/desired orientation, it can be 'fastened off'.

In some embodiments, the position of the or each spigot at the at least two flanges and along the stringer may be adjusted so as to space the tread support that is mounted thereto at a predetermined distance from an adjacent tread support in use. In this way, a suitable/desired spacing of tread members (i.e. stairs) may be attained in use.

In some embodiments, the at least one spigot may also comprise a box-section profile. For example, one side wall of the box-section profile may locate in adjacency of and/or may abut one of the at least two flanges. Further, an opposing side wall of the box-section profile may locate in adjacency of and/or may abut another one of the at least two flanges. Suitable (e.g. self-tapping) fasteners may then extend through a given spigot side wall and its respective stringer flange to thereby fasten the spigot to the stringer. Again, the spigot box-section profile can be a structural profile that can accommodate the various loadings that are applied thereto in use.

In some embodiments, an internal surface of at least one of the walls of the spigot box-section profile may be provided with one or more fastener retention formations. These formations can be provided to enable a respective tread support to be fastened to the spigot. In this regard, each formation may be configured to fasteningly receive a respective fastener therein. For example, the respective fastener may extend from and through the tread support to fasten the tread support to the spigot to thereby couple the tread support to the stringer.

For example, each fastener retention formation may comprise a flute that is formed to extend along the internal surface of a respective wall of the spigot profile. Each flute may be generally tubular, but may have an elongate opening along a wall that extends inwardly of the spigot. Each flute may be configured to receive therein a respective fastener (e.g. the shank of a self-tapping fastener) that extends from and through the tread support. For example, two or more (e.g. up to four) such formations (e.g. flutes) may be formed along the internal surfaces of each of opposing walls of the spigot profile. These opposing walls may be the same walls that locate in adjacency of (e.g. that abut) the corresponding stringer flanges.

In some embodiments, the at least one tread support may comprise an elongate plate. Opposing flanges may extend along respective long sides of the elongate plate. A front such flange may be arranged to project downwards in use. Conversely, a rear such flange may be arranged to project upwards in use. This can give the tread support a generally S-shaped profile (i.e. when viewed end-on). In use in a staircase, a front such flange of a given tread support can project down towards a rear such flange of a next lowermost tread support. This can serve to 'narrow' the space between adjacent tread supports (i.e. to close any gap that infants may fall through, but also to make the staircase compliant with various standards that can apply to staircase construction). The rear such flange of each tread support can provide a backing for a tread/step in use (i.e. once mounted to the tread support).

In some embodiments, the staircase may further comprise at least two brackets (i.e. staircase mounting brackets). Each bracket may mount to the at least one stringer at a respective in-use lower or upper end thereof. Each bracket may be configured to connect its respective lower or upper stringer end to the respective first and second floors (or landing(s)) of the building structure.

For example, each of the at least two brackets may comprise a floor-mounting portion for connecting the bracket to the first or second floor (or landing(s)) of the structure respectively. Each bracket may also comprise a stringer-mounting portion for connecting the bracket to the lower or upper stringer end respectively.

In some forms, the floor mounting portion of each bracket may comprise a plate. The plate may be configured to have one or more fasteners extend therethrough to secure the plate to the first or second floor (or landing(s)) of the structure respectively.

In some forms, the stringer-mounting portion of each bracket may comprise first and second spaced flanges. Each flange may be configured for location adjacent to a respective side wall at a respective end of the stringer box-section profile. When so-located, each flange may be fastened to its adjacent respective wall in use. For example, the first and second flanges may be spaced for insertion into an open end of the stringer box-section profile such that, when inserted, each flange can locate adjacent to (e.g. to abut) its respective side wall in use. In a like manner to the spigot, each flange may be configured for being adjusted with respect to the in-use 'angle of extent' of the stringer. In this regard, each flange may be cut/shaped-typically on site (e.g. 'cut-to-measure') such that each flange generally extends from the floor mounting portion at an angle that corresponds to the stringer angle of extent. Again, the ability to adjust each bracket on site contributes to the modularity of the staircase.

In some embodiments, opposing in-use side walls of the at least one elongate stringer may each have two spaced parallel elongate grooves defined therein. The grooves may run for the length of the stringer side wall. Each of the two stringer grooves may be configured in use to have one or more fasteners extend therethrough and into fastening engagement with a respective one of the first and second flanges to secure a respective end of the stringer to the bracket. This can secure the end of the stringer to the first or second floor (or landing(s)) of the structure respectively. In use, a head of the one or more fasteners may locate and be retained within a respective stringer groove to be inside a line of the stringer side wall (e.g. out of the way of a capping element as set forth below).

In some embodiments, the staircase may further comprise at least one tread member (e.g. step/stair). Each tread member may be configured to locate at and be supported at a respective tread support. For example, each tread member can be elongate, having opposing ends spaced apart to define a tread surface therebetween. An in-use lower surface of the tread member may be arranged proximal to (e.g. to be secured to) the tread support. The tread member can be supported by the at least one stringer. For example, a single stringer can be arranged intermediate opposing ends of the tread member, or two spaced stringers can be arranged with respect to opposing ends of the tread member.

Each tread member and its respective tread support may be arranged to extend laterally from and transverse to the stringer in use. For example, each tread member and its respective tread support may be mounted with respect to a given stringer such that:

the given stringer is centrally arranged under each tread member and tread support;

each tread member and tread support extends in a cantilever configuration with respect to the given stringer;

each tread member and tread support is mounted at one end with respect to the given stringer, and extends therefrom to another (e.g. parallel) spaced stringer to be mounted at an opposite end to the other stringer.

In some embodiments, the staircase may further comprise at least one stiffener plate. The stiffener plate may be configured to locate at and be supported at a respective tread support. For example, the stiffener plate may be located in use between the tread member and the tread support. The stiffener plate and tread support may each be arranged to extend laterally from and transverse to the stringer in use.

In some embodiments, the staircase may further comprise elongate capping elements. Each capping element may be configured for mounting to, to at least partially conceal, a respective adjacent surface of the stringer. The capping elements can 'finish-off' the staircase and can enhance the overall aesthetics of the staircase once installed.

For example, two elongate capping elements may each be provided that are configured for mounting to and along respective side walls of the stringer. Each such 'side' capping element may comprise a first lip that extends along and projects inwardly from a long side of the capping element. The first lip may be configured to interact with a respective one of the at least two flanges that projects from the first wall of the stringer. Each such 'side' capping element may also comprise a second lip that extends along and projects inwardly from an opposite long side of the capping element. The second lip may be configured to interact with an opposite second wall of the stringer. The first and second lips of each 'side' capping element may be configured to retain each capping element to a respective side wall of the stringer.

In a further example, a second single elongate capping element may be configured for mounting to and along the first wall of the stringer. The single 'upper' capping element may comprise a first lip that extends along and projects inwardly from one long side of the single capping element. The first lip may be configured to interact with a respective one of the at least two flanges that projects from the first wall of the stringer. The single 'upper' capping element may also comprise a second lip that extends along and projects inwardly from an opposite long side of the single capping element. The second lip configured to interact with a respective other of the at least two flanges that projects from the first wall of the stringer. The first and second lips of the 'upper' capping element may be configured to retain the single capping element to the two flanges and thereby to the first (in-use upper) wall of the stringer.

Also disclosed herein is a stringer for use in a modular staircase. As set forth above, such a stringer can be elongate and can have a box-section profile. In accordance with the disclosure, the stringer can comprise at least two flanges projecting upwardly in-use from an upper wall of the box-section profile. As set forth above, such flanges can facilitate the adjustable mounting thereto of one or more tread-supporting spigots.

In some stringer embodiments, each flange may be located to extend along and adjacent to but inset from a respective side wall of the box-section profile. Thus, when a fastener extends laterally through the flange, a head of the fastener may locate inside a line of the respective stringer side wall.

In some stringer embodiments, each flange may comprise a lip at its distal end. Each lip may project laterally outwards therefrom. For example, each lip may project laterally outwards from the flange distal end to an extent such that the lip distal edge is located at or inside a line of the stringer side wall. Each lip may facilitate the mounting of a respective 'side' capping element to a respective stringer side wall (as set forth above). For example, each flange lip may be bevelled at its in-use upper surface such that a first capping lip of its respective 'side' capping element is able to ride or travel over the flange lip and into engagement with the stringer flange.

In some stringer embodiments, the stringer box-section profile may comprise an in-use lower wall that opposes the stringer upper wall. Further, respective and opposing side walls may extend between the lower and upper walls. The stringer lower wall may be configured with a thicker wall section than the stringer upper wall. As a result, the thicker stringer lower wall, which is under tension when loaded, is thereby better able to absorb and withstand the dead load and dynamic loading applied thereto in use.

In some stringer embodiments, each of the stringer lower wall and upper wall may be configured with a thicker wall section than the stringer side walls. Again, the thick stringer lower wall which is under tension when loaded, and the thick stringer upper wall which is under compression when loaded, are better able to absorb and withstand the dead load and dynamic loading applied thereto in use. Conversely, the stringer side walls serve to translate the loading from the stringer upper wall to the stringer lower wall.

In some stringer embodiments, opposing in-use side walls of the stringer may each have two spaced parallel elongate grooves defined therein. As set forth above, the grooves may run for the length of the stringer side wall. As also set forth above, each of the two stringer grooves may be configured in use to have one or more fasteners extend therethrough. Further, a head of the one or more fasteners may locate and be retained within a respective elongate stringer groove to be inside a line of the stringer side wall (e.g. out of the way of the 'side' capping element as set forth above).

Also disclosed herein is a method for constructing a staircase for a structure. The method can be deployed for each of the various configurations of the modular staircase as set forth above (e.g. central-spine, cantilever, conventional-form-two-stringer, etc.).

The method can comprise mounting an in-use lower end of the at least one stringer as set forth with respect to a first floor (or landing) of the structure. The method can also comprise mounting an in-use upper end of the at least one stringer as set forth above with respect to a second floor (or landing) of the structure.

The method can further comprise mounting a plurality of spigots and respective tread supports, as set forth above. The spigots and respective tread supports can be arranged in a spaced relationship along length of the stringer to enable a plurality of tread members to be mounted to the staircase.

In some embodiments of the method, the lower and upper ends of the at least one stringer may be mounted with respect to the first and second floors (or landing(s)) by mounting brackets as set forth above.

In some embodiments of the method, a plurality of tread members, tread supports and, optionally, a plurality of respective stiffener plates may be mounted with respect to the tread supports as set forth above.

In some embodiments of the method, a plurality of capping elements may be mounted to, to at least partially conceal, respective adjacent surfaces of the at least one stringer as set forth above.

Also disclosed herein is a modular staircase suitable for use in a structure. The staircase can comprise at least one stringer having an elongate axis. The stringer can be configured for extending between a first floor of the structure and a second floor of the structure. The stringer can have a box-section profile and at least two flanges projecting from a first wall of the stringer profile.

At least one spigot can be configured as a box-section profile for mounting with the at least two flanges. One side wall of the box-section profile can be configured to locate in adjacency of and/or to abut one of the at least two flanges. An opposing side wall of the box-section profile can locate in adjacency of and/or to abut another one of the at least two flanges such that an axis of the spigot is able to extend at an angle with respect to the stringer elongate axis.

At least one tread support can be provided for coupling to the stringer via the at least one spigot. When the angle of the spigot axis is adjusted relative to the stringer elongate axis, the tread support is able to be orientated at an angle relative to the stringer in-use.

In some variations of the method, just one stringer may be mounted to extend between the first and second floors (or landing(s)). The plurality of spigots and respective tread supports may be mounted to the one stringer to enable each of a plurality of tread members to be mounted to the staircase at a location that is either: intermediate opposite ends of each tread member; or cantilevered from an end of each tread member.

In other variations of the method, two spaced, e.g. parallel stringers may be mounted to extend between the first and second floors (or landing(s)). The plurality of spigots and respective tread supports may be mounted to each of the two stringers in the same spacing and orientation to enable each of a plurality of tread members to be mounted to the staircase at a location that spans between the two stringers.

BRIEF DESCRIPTION OF THE DRAWINGS

Specific embodiments will now be described, by way of example only, with reference to the accompanying drawings, in which:

FIG. 4A shows a top view of a tread support, with spigot and stiffener plate shown by hidden lines; FIG. 4B shows an end view of a tread support; and FIG. 4C shows an end view of a tread support and stiffener plate secured, in-use, to a spigot, and a tread member and respective fasteners positioned in-line for assembly onto the tread support.

FIG. 5A shows a side view of a stringer mounted together with a bracket; FIG. 5B shows an end view of the bracket in FIG. 5A mounted together with a stringer (with the stringer profile shown in hidden lines); FIG. 5C shows an end view of the bracket; and FIG. 5D shows a detailed view of a fastener, with recessed fastener head, connecting between the stringer and bracket shown in FIG. 5A.

DETAILED DESCRIPTION OF THE INVENTION

Figure 1:
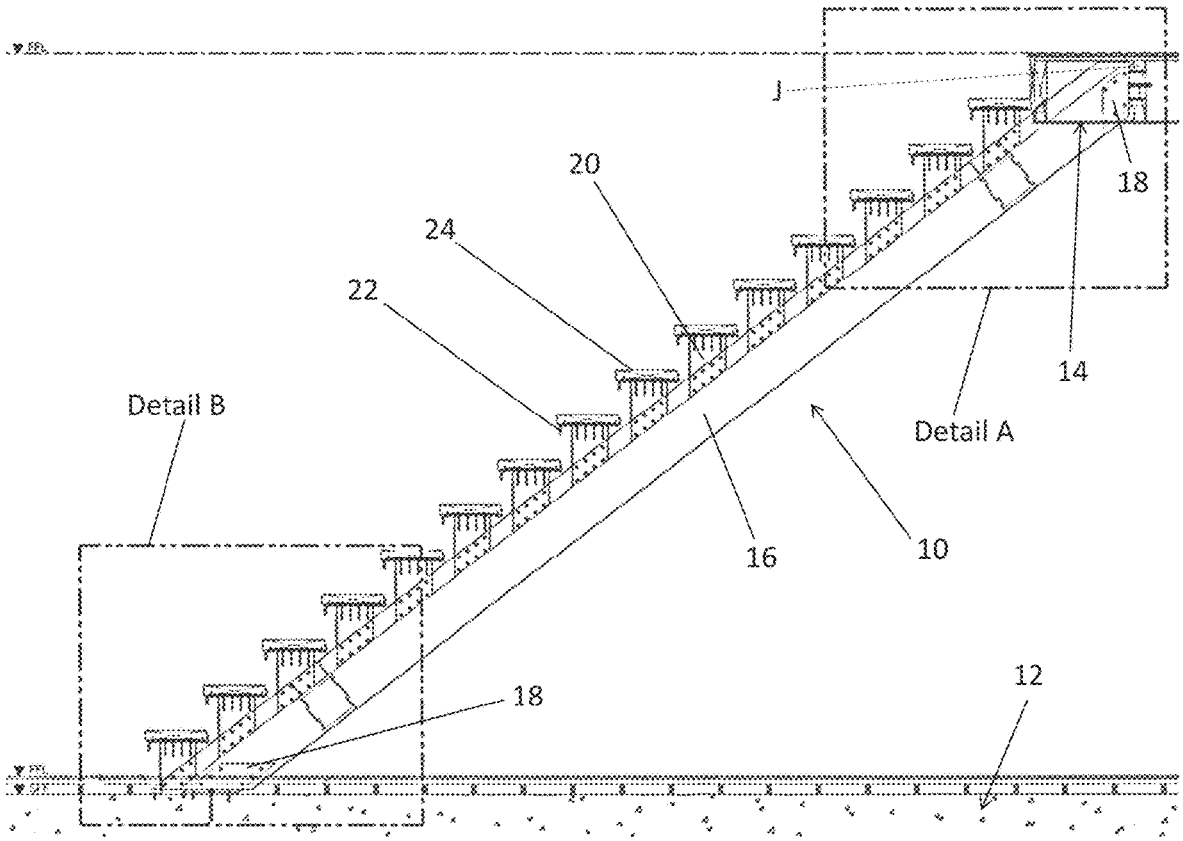
FIG. 1 shows a sectional side view of a modular staircase.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Referring firstly to FIG. 1, a side view of a modular staircase 10 according to the disclosure is shown in-use (i.e. installed) within a structure (e.g. between floors of a building). The structure can be e.g. a residential or commercial building and the staircase 10 can be configured to extend between floors of the building. As shown in FIG. 1, for example, the staircase can extend from a first, i.e. underlying (or ground) floor 12, to a second, i.e. overlying second floor 14. In particular, the staircase can be configured to connect at a structural floor level/foundation (SFF) at the first floor and can extend to the finished floor level (FFL) of the second floor.

In some forms not shown, the staircase can extend from the first floor to the second floor via intermediate landings. In this form, the staircase can connect to the landing in a similar way to the connection between the staircase and respective overlying and underlying floors, as described hereafter. In some forms not shown, the staircase can extend between landings.

The modular staircase 10 comprises at least one stringer 16 configured to extend between and connect to the first and second floors 12,14. The staircase 10 can comprise a single stringer 16, or two (or more) parallel stringers 16. Each stringer 16 is connected to the first and second floors 12,14 via brackets 18 mounted to opposing ends of the stringer 16. A plurality of spigots 20 are mounted along an elongate length of the stringer 16 for coupling tread supports 22 to the stringer 16. As shown in FIG. 1, each tread support 22 is coupled to the stringer 16 via a corresponding spigot 20. Described in further detail hereafter, the number and spacing of the spigots can be modified according to the specific design of the building, e.g. the distance between first and second floors, and the pitch of the staircase extending therebetween.

The tread supports 22 extend for a width of the staircase and are connected to corresponding tread members 24. The tread members, i.e. the steps, of the staircase are in contact with a user's feet when the staircase is in-use, e.g. when the user is walking upward or downward across the staircase. Because of the tread supports 22, the tread members 24 can be embodied in a variety of material types including timber, metal, polymer, composite, tile, carpet, concrete, or other type of floor covering.

Figure 2:
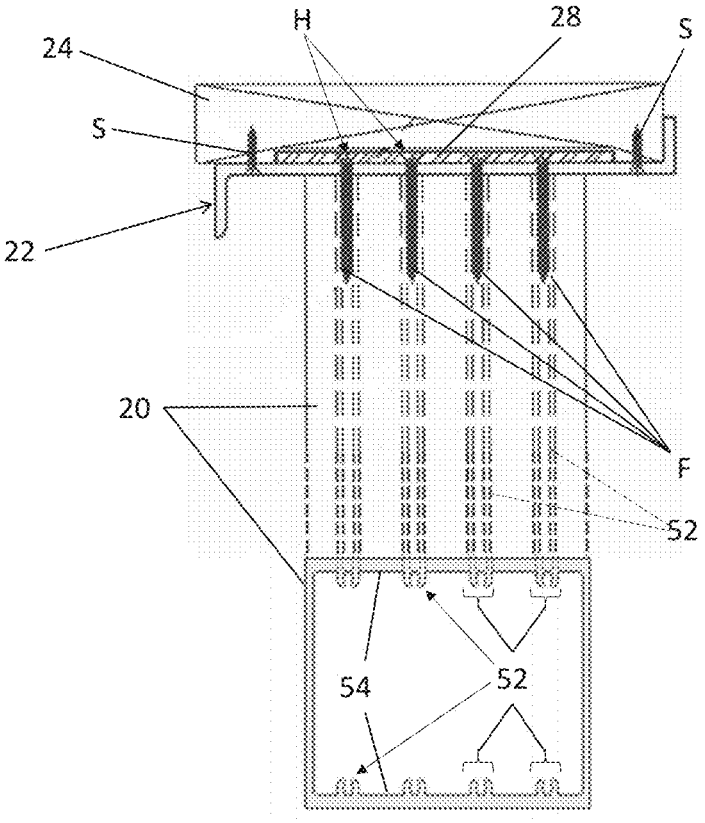
FIG. 2 shows a sectional side view of a step of the modular staircase shown in FIG. 1.

As shown in FIG. 2, a stiffener plate 28 is arranged between the tread members 24 and the tread supports 22 to both stiffen and enhance the load bearing capacity of the tread members when in-use. As described in more detail hereafter, the stiffener plate 28 minimises deflection in the tread member 24 when a user is walking, i.e. applying load across each step.

Referring again to FIG. 2, the tread member 24, the stiffener plate 28, tread support 22 and spigot 20 are shown in an assembled state. Together, these components form discrete step units comprising a 'riser' (i.e. the spigot) and a 'tread' (i.e. the tread member, tread support and stiffener plate). In other words, the riser (spigot 20), supports directly beneath a respective tread member 24 and spaces the tread vertically and horizontally from adjacent treads.

Figures 3A, 3B:
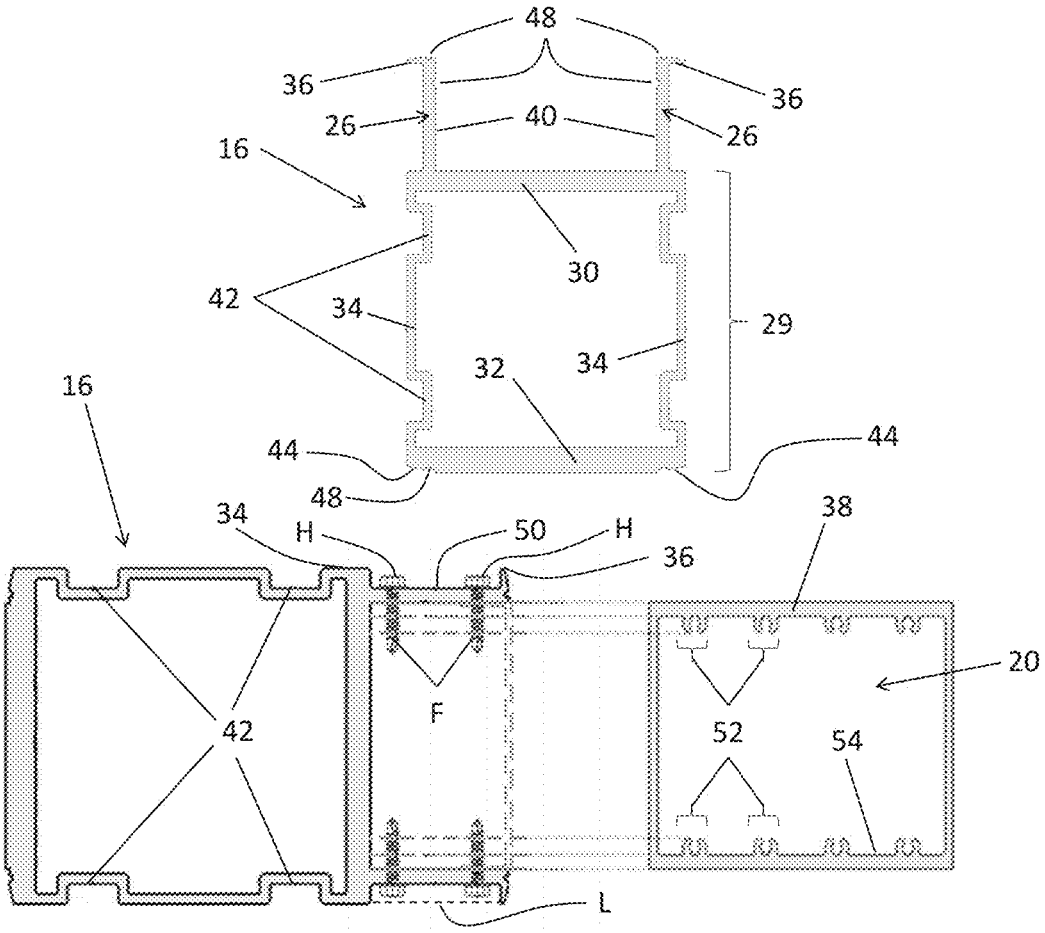
FIGS. 3A and 3B show respectively, a stringer viewed from an end thereof, and a stringer mounted to a spigot (where a section profile of the spigot is shown in solid lines and the elongate length of the spigot is indicated by hidden lines).

The components of the staircase will now be described in detail. Referring firstly to the stringer as shown in FIGS. 3A and 3B, the stringer 16 can be configured with a profile i.e. a cross-section, as shown in FIG. 3A, where the profile is generally box-shaped in section. The box-shaped profile is formed into an extruded member, e.g. beam as shown in FIG. 1. This profile provides stiffness/rigidity and load-bearing capacity to the stringer 16.

The box-shaped profile of the stringer 16 comprises a body 29 wherein two flanges 26 project from a wall 30 of the body 29. FIGS. 3A and 3B illustrate the stringer profile orientated in an upright position, i.e. an in-use orientation whereby the two flanges 26 extend upwardly and project away from upper wall 30 of the body 29. In the form shown in FIGS. 3A and 3B, the upper wall 30 is configured to have a wall section thickness less than the wall section thickness of a lower wall 32. This is because, under load, the lower wall 32 is placed into tension, whereas the upper wall 30 is placed into compression.

The flanges 26 are spaced apart such that spigot 20 can be mounted therebetween. As shown by the hidden lines in FIG. 3B, the spigots 20 (also shown arranged in FIG. 1 spaced across the elongate length of the stringer) each fit between the two flanges 26. As explained below, an in-use lower end of the spigot 20 is cut at an angle to correspond to the angle of the stringer (i.e. such that the spigot extends generally vertically in use, as shown in FIG. 1).

As illustrated, the side walls 38 of the spigot 20 are sized so as to contact, or at least be positioned in close proximity to inside walls (i.e. opposingly faced surfaces) 40 of flanges 26. In some forms, the side walls 38 of the spigot may be dimensioned such that, when mounted between the two flanges 26, the spigot has an interference-type fit. Providing this fit between the components has the advantage of allowing the spigot to be arranged at a desired orientation (e.g. angle and spacing) without additional clamping means, prior to fastening the spigot to the stringer 16. In other words, the flanges can provide a self-clamping effect when a spigot in positioned therebetween.

Once a spigot is positioned and held in place by the inward clamping pressure of the flanges 26, the spigot may be spaced along the length of the stringer 16 relative to adjacent spigots, according to the design requirements of the staircase. Similarly, adjustments can be made to the angle of the spigot relative to the stringer. It is an advantage that at least the abovementioned adjustments can be made to the position of the spigot prior to e.g. drilling through the stringer and spigot with e.g. self-tapping screws (F).

The side walls 34 of the stringer body 29 can each comprise two spaced parallel elongate grooves 42. In the form shown in FIGS. 3A and 3B, the grooves on each sidewall are spaced apart such that a first of the two grooves is positioned closer to the lower wall 32 of the body 29, and a second of the two grooves is positioned closer to the upper wall 30 of the body 29. The grooves 42 are described in further detail below.

The flanges 26 of the stringer 16 are configured with lips 36 projecting from distal (i.e. terminal) ends. The lips 36, together with recesses 44 of the lower wall 32, are shaped to receive and retain corresponding lips 84 on side capping elements **76*a* (described in further detail below, and also shown in FIG. 13). The side capping elements 76*a* are configured to conceal (i.e. aesthetically) the side walls of the stringer 16 such that fasteners positioned in grooves 42** are not visible once the staircase module is completely assembled.

As described in further detail later (and with reference to FIG. 13), an upper capping element **76*b*, similar in design to each side capping element, can be provided to releasably connect with, and span between, inside walls 40 of flanges 26. For each of the side capping elements 76*a* and upper capping element 76*b*, notches 48 are provided to allow the capping elements to snap-engage into position on the stringer 16** to be retained thereat.

Referring in particular to FIG. 3B, the spigot 20 is shown mounted to each of the flanges 26 via fasteners F, which can each take the form of a self-tapping screw. An outside wall 50 of the flange is positioned in line with each of the grooves 42 in a corresponding sidewall 34 of the body 29 of stringer 16. The lips 36 of the flanges 26 and the side walls 34 of the body 29 are each spaced from the outside wall 50 of the flanges such that a head (H) of the fastener (F) is inside a line (L) of the stringer side wall 34. Advantageously, positioning the heads (H) of the fasteners (F) inset from the side wall 34 allows the abovementioned side capping elements **76*a*** to enclose and conceal the heads (H).

As shown by the hidden lines extending from an end of the spigot 20 (shown in profile), the end of the spigot can be configured to contact, or at least be in close proximity to the upper side wall 30 of the body 29. In this way, and as shown in FIG. 1, when the stringer 16 is angled (in-use, between first and second floors 12,14) the end of the spigot may be cut at a complimentary angle (to the stringer) such that, when the spigot is mounted to the flanges 26, the angle of the cut end of the spigot arranges the elongate length of the spigot in a desired (i.e. as designed) angle (e.g. vertically or vertical).

As shown in FIG. 1, the spigots 20 arranged across the elongate length of the stringer 16 are typically perpendicular to the finished floor level (such that the tread members 24 are parallel to the finished floor level). As such, if the stringer 16 is angled at e.g. 35° to the finished floor level, the end of the spigot can be cut at an angle of 55° (relative to an elongate length of the spigot) such that, when the cut end of the spigot is mounted to the flanges 26, the end of the spigot (i.e. a cross-section of the spigot) is parallel with the upper wall 30 of the stringer 16 and in turn, the elongate length of the spigot is angled at 90° to the finished floor level.

Providing an end of the spigot 20 that is cut to compliment the angle of the stringer 16 can allow the end of the spigot to at least partially contact (e.g. fully abut) the stringer. In other forms, the spigot 20 can be spaced from the upper wall 30 of the stringer 16 such that the spigot is suspended above the upper wall 30 and, instead, is solely supported by the fasteners (F) that extend through the flanges and through corresponding walls of the spigot. In each case, the fasteners (F) support at least part of the load transferred through the spigot 20 when a user steps on a tread member when traversing the modular stairs in use. In some cases, at least part of the load applied by the user stepping on the tread member can be transferred through the spigot directly (i.e. via the end of the spigot contacting the upper wall 30) into the stringer 16. In such cases, the fasteners (F) function mainly to hold the spigot 20 in place on the stringer 16.

Referring again to FIG. 2, it will be seen that the tread support 22 is mounted to the in-use upper end of the spigot 20 extending from the stringer 16. In particular, an underside of the tread support 22 contacts the spigot upper end and is fastened in position thereat by fasteners (F) (e.g. self-tapping screws) that extend from a tread support top side (i.e. a side opposing the underside of the tread support) and through and into flutes 52 of the spigot 20 (described in more detail below).

A stiffener plate 28 can be positioned in-use, between the heads (H) of the fasteners (F) and the tread support 22. Specifically, the stiffener plate 28 can be structurally secured to the tread support 22 by the heads (H) of the fasteners (F). In variations, the stiffener plate can be positioned and secured at an underside of the tread support such that the stiffener plate is located (e.g. sandwiched) between the upper end of spigot 20 and the tread support 22. In either arrangement, the stiffener acts to increase the effective wall thickness of the tread support such that the stiffness and rigidity of the tread support is increased. This is advantageous as the stiffener plate 28 can reduce the deflection of the tread support 22 and in turn, the tread member when a user traverses the modular stairs (i.e. applies a load to the tread member). This can allow for a floor material to be used over the tread support 22 that does not tolerate much flexion (e.g. tiles, etc.).

As above, flutes 52 are formed along an internal surface 54 of the spigot. The flutes receive respective fasteners (F). In some forms not shown, the side walls 38 of the spigot 20 may be thickened such that the flutes 52 may be substituted with apertures. By providing flutes 52 (or apertures) along the internal surface 54 of the spigot, the side walls 38 can also be formed with a thin wall section. Advantageously, providing flutes 52 instead of a thickened wall section can reduce the weight of the spigot, that in turn, can reduce the weight of the modular stairs. This can assist with ease of transport when moving components on-site during assembly.

The spigot 20 shown in FIG. 2 comprises eight flutes 52 for receiving eight corresponding fasteners (F) when securing the tread support 22 and the stiffener plate 28 thereat. It is anticipated that more or less flutes and corresponding fasteners can be provided for mounting the tread support and stiffener plate to a respective spigot. Furthermore, the configuration of the flutes 52 on the internal surface 54 can be adjusted according to loading conditions of the staircase or a particular design of the staircase. For example, a curved staircase (i.e. having a curved stringer) may require the tread support to be differently mounted to a respective spigot.

Referring now to FIGS. 4A, 4B, and 4C, the tread support 22 is shown comprising apertures A and A' arranged for receiving respective downwardly-directed fasteners (F): for securing the tread support 22 to the spigot 20; and upwardly-directed fasteners (S): for securing the tread support 22 to a respective tread member 24.

In the form shown in FIGS. 4A and 4B, the arrangement in tread support 22 of the apertures A for receiving fasteners F have a centralised location on the tread support. In this form, the tread support 22 of FIGS. 4A and 4B is configured for use with a stringer coupled via single spigot 20 at an intermediate (e.g. central) location relative to opposite ends of the tread support 22.

Further, apertures A' are configured to receive fasteners (S) for securing a tread member 24 to a respective tread support 22. The apertures A' are arranged towards opposing ends of the elongate length of the tread support 22. The tread member 24 shown in FIG. 4C is positioned in-line for assembly onto the tread support 22. The tread member 24 may be fastened to the tread support 22 by fasteners (S) that, as indicated by phantom lines, extend through the apertures A' of the tread support and up into the tread member 24. The tread member can comprise a suitable material (e.g. timber, metal, composite, polymer, etc.) into which the upwardly-directed fasteners (S) tap into.

FIG. 4A also shows that each tread support 22 comprises an elongate plate 56 having opposing flanges 58, 60 extending along respective elongate sides of the plate 56. Referring in particular to FIG. 4B, a side (i.e. end) view of the tread support 22 is shown whereby the tread support is in its typical in-use, horizontal orientation. In other words, the orientation of the tread support 22 in FIG. 4B is the same as the orientation of the tread support shown assembled, in-use, in the modular staircase of FIG. 1. In this orientation, it can be seen that a front such flange 58 (i.e. a nosing of the tread 22) is differently shaped to a rear such flange 60. Each of the front flange 58 and rear flange 60 are now described in further detail.

The front flange 58 projects downwardly in use and is configured to narrow a space between adjacent tread supports 22 (e.g. to be narrower than that which an infant may pass therethrough, according to relevant building codes or standards). As such the length of the flange 58, i.e. its downwards extent towards an underlying tread support (and tread member), is typically configured to be longer/greater than the opposing upwardly projecting rear flange 60. The length of the flange 58 can therefore be longer or shorter according to the particular design requirements of the modular staircase (and the structure the modular staircase is installed within) taking into account the corresponding building codes/standards. Additionally, the length of the flange 58 can be longer or shorter according to the particular design requirements of the modular staircase to the extent that the structural integrity of the tread is not compromised.

The rear flange 60 projects upwardly and is mainly configured for receiving a tread member 24 thereat (i.e. to act as a real support against laterally-directed forces). It can be seen that the length of the rear flange 60 is shorter, i.e. its upward extent is less than the downward extent of the front flange 58. Further, the rear flange 60 extends from the plate 56 having an interior edge 62 for receiving a corresponding edge of the tread member 24. As shown in FIG. 2, when the tread member 24 is mounted in-use on the tread support, the edge of the tread member 24 abuts/sits flush into the interior edge 62 such that sides of the tread member 24 are in surface-to-surface contact with the plate 56 and rear flange 60. Advantageously, the surface-to-surface contact of tread member and tread support can further contribute to the stiffness of the tread support.

The opposing (i.e. upwardly and downwardly projecting) flanges 58, 60 may also assist with the structural integrity of the tread. For example, the front flange 58 and rear flange 60 both increase the torsional strength of the tread 24.

The front flange 58 can be provided with a fillet 63 (FIG. 4B), i.e. a rounded juncture between the front flange 58 and the plate 56. Similarly, an end 58*a* of the front flange distal to the plate 56 can also be provided with a fillet. In each case, the fillet provided at the front flange can indicate to a person installing the tread support into a modular staircase the correct orientation of the tread member. That is, the front flange 58 is shaped differently to the rear flange 60 to indicate which flange is the front flange, and which is the rear flange. The fillet 63 can also increase the deflection-resistance of the front flange 58.

Each tread support 22, together with the tread member 24, can support the weight (i.e. loading) of users traversing across the stairs. As such, the tread support and tread member are designed to support both dynamic and static loads. The stiffener plate 28 (as described previously), together with the tread support 22 and tread member 24, stiffen the tread such that, when a user is traversing the modular stairs, the static (e.g. from dead loads) and dynamic (i.e. from vibration) deflection of the tread is minimised.

In the form shown in FIGS. 4A and 4C, the stiffener plate 28 is dimensioned relatively larger than the spigot 20 box-section profile (as shown in hidden lines in FIG. 4A for each of the spigot 20 and the stiffener plate 28). In other words, the stiffener plate 28 can be rectangular shaped and sized slightly larger (i.e. have a slightly larger foot-print) than the cross-sectional shape of the spigot 20. As shown in FIG. 4C, the stiffener plate, in-use, is compressed against the tread support 22 by fasteners (F) such that the tread support is 'sandwiched' between the stiffener plate 28 and the spigot 20. As previously discussed, the stiffener plate 28 increases the thickness of the tread support (i.e. increases the combined section thickness of the stiffener plate and tread support) at the connection between the stiffener plate and the tread support. Advantageously, this can dampen vibrations (i.e. dynamic loads) induced in the tread (support 22 and member 24) when a user traverses upwards or downwards across the staircase.

In some forms not shown, the stiffener plate can be sized to extend across (e.g. partially or fully across) the elongate length of the tread support. For example, in the case where the modular staircase has two spaced (e.g. parallel) stringers with treads spanning between the stringers. In such a form, the stiffener plate may be configured to be secured at, so as to extend between, two spaced spigots 20 (corresponding with the two spaced stringers 16) at opposite ends of the tread support.

Referring now to FIGS. 5A and 5B, the stringers 16 of the modular staircase can be mounted to the underlying floors (e.g. first (or lower) floor 12 as per FIG. 1) and overlying (e.g. second (or upper) floor 14 as per FIG. 1) of a structure via brackets 18 connected at respective upper and lower opposite ends of the stringer 16.

Referring to FIG. 5C, the bracket 18 comprises a floor-mounting portion 64 for connecting the bracket to either first or second floors 12,14, and a stringer-mounting portion 66 for connecting the bracket to either the lower or upper ends of the stringer 16. Each of the floor-mounting portion 64 and stringer-mounting portion 66 are described in further detail below.

The stringer-mounting portion 66 of each bracket 18 comprises first and second spaced flanges 70 for inside mounting to either upper or lower ends of the stringer 16. The flanges 70 extend from a plate 68 of the floor-mounting portion 64 and are spaced apart such that both flanges 70 can be positioned within the side walls 34 of the stringer body 29. As best shown in FIG. 5B, the flanges 70 are spaced apart such that, when inserted into the stringer body at either upper or lower ends of the stringer 16, the flanges contact inside faces of each of the two spaced parallel elongate grooves 42 (previously defined). In some forms, the two spaced grooves 42 and the flanges 70 can be dimensioned such that the flanges are in interference (i.e. an interference fit) with the grooves 42 when mounted thereat.

Advantageously, by providing an interference fit between the grooves 42 and flanges 70, this can allow the flanges 70 to retain the bracket 18 in position at an end of the stringer 16 prior to connecting the flanges with the stringer. In other words, providing an interference fit between the bracket 18 and the stringer 16 allows a user, when installing the modular staircase, to orientate the bracket 18 at a desired (e.g. designed) angle with respect to the stringer before securing the bracket 70 and stringer together with fasteners (F), as shown in FIG. 5D.

As best shown in FIG. 5A, when mounted to the stringer 16, the edges of the flanges 70 (indicated by hidden lines (P)), are sized to extend within the stringer body 29 from the lower wall 32 to the upper wall 30. Further, the flanges 70 can extend from an open end of the stringer 16, and partway through the elongate length of the stringer body 29. As shown in FIG. 5A, the flanges are sized to extend along the elongate length of the stringer body 29 by a predetermined (i.e. sufficient) distance.

The flanges 70 are provided with chamfered distal ends 72 (i.e. ends distal to the floor-mounting portion 64). The chamfered ends 72 can assist with mounting of the flanges 70 to the stringer 16 by guiding the flanges into the stringer body 29. Advantageously, if the flanges are configured to interferingly fit together with the grooves 42, the chamfered ends 72 provide a narrowed leading edge of the flanges such that the leading edge can readily fit within the open end of the stringer to then lead the flanges 70 into interfering engagement with the grooves 42.

Figure 6:
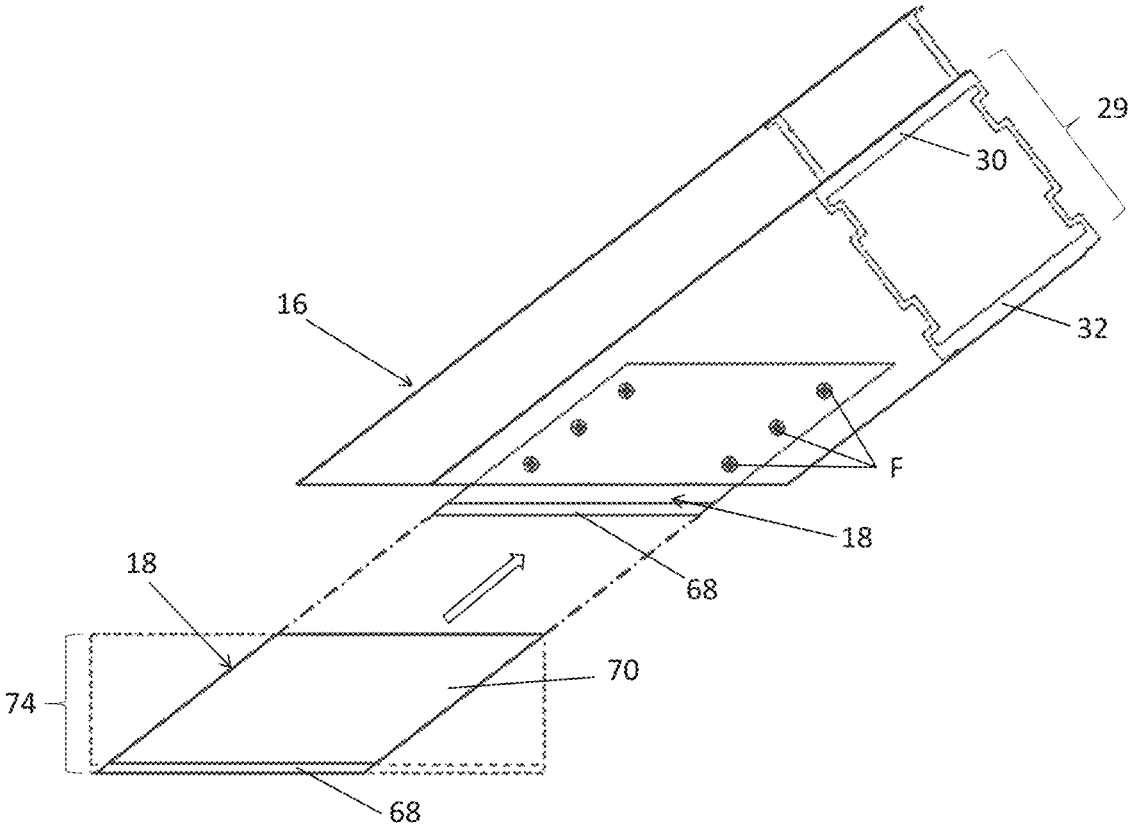
FIG. 6 shows a side view of a bracket positioned in-line for mounting to a stringer with phantom lines indicating a path of movement of the bracket into a mounted position with the stringer, and with phantom lines indicating a cross-sectional profile of the stringer.

Referring briefly now to FIG. 6, the bracket 18 is shown in-line for assembly with a stringer 16. Phantom lines extending between the bracket and stringer indicate the path of movement the bracket would take when being mounted into the stringer body 29.

The bracket 18 can be provided as an extruded section 74 having the end profile as shown in FIG. 5C. The bracket 18 can be cut-to-measure according to the angle of the in-use stringer 16 connecting between the first and second floors of a structure. As shown by FIG. 6, the extruded section 74 is indicated by dashed lines, with the bracket 18 denoted by solid lines, being cut-to-measure from the extruded section 74. It can be seen that, when viewed from a side, the bracket 18 (in solid lines) is shaped such that the flanges 70 extend from the floor-mounting portion at an angle that matches the angle of the stringer 16 relative to the finished floor level.

In the form shown in FIG. 6, the stringer 16 extends at included angle of approximately 35° to the floor, with the flanges 70 of the bracket being cut at a corresponding angle of 35°. The bracket can then be moved into the stringer body 29 (as indicated by the phantom lines extending from the bracket 18) whereby the cut-to-measure edges of the bracket 18 can be guided (e.g. by contact) with the upper and lower walls 30,32 of the stringer body 29. In some forms, the cut-to-measure edges of the bracket 18 can be sized such that, when mounted to the stringer in-use, the cut-to-measure edges of the bracket 18 are spaced from the upper and lower walls 30,32 of the stringer body 29.

While the stringer 16 shown in FIG. 6 is angled at approximately 35° to the finished floor level, it is anticipated that the stringer 16 can be orientated at other angles depending to the design requirements of the modular staircase (e.g. steeper or shallower stairs). Accordingly, the angle at which the bracket 18 is cut can be adjusted according to the angle of the stringer. In this way, the bracket 18 (i.e. the extruded section 74) is modular and can be modified onsite, e.g. cut-to-measure by a builder, according to the angle of the stringer when extending between overlying and underlying floors.

As set forth above, the flanges 70 of the bracket 18 are connected to the stringer 16 via fasteners (F). Referring again to FIG. 5A and, in particular, the detail view shown in FIG. 5D, the fasteners (F) extend through the grooves 42 of the stringer and into fastening engagement with the flanges 70 of the bracket 18. In the form shown in FIG. 5A, six fasteners are provided to connect each of the two flanges 70 with the adjacent groove 42 of the stringer 16. In other forms, more or less fasteners can be provided according to the design requirements of the modular staircase.

The grooves 42 of the stringer 16 are configured to receive, and inset, a head (H) of the fastener (F) with respect to a line L of the stringer side wall 34. Advantageously, by positioning the heads (H) of the fasteners (F) inset from the side wall 34, this allows side capping elements 76*a* (shown in FIG. 13) to flush-mount at the side walls 34 to enclose the heads (H). The side capping elements 76*a* are described in further detail below.

As set forth above, the floor-mounting portion 64 of bracket 18 comprises a plate 68 for mounting to, e.g. against, either a first or second floor. For example (and as shown in FIG. 1), the bracket 18 can be mounted at a structural floor level (SFF) to enable the stringer 16 to extend upward from the first floor towards the second floor and through a finished floor level (FFL) located just above the structural floor level (SFF). This enables the bracket 18 to be concealed below the FFL. Also, in FIG. 1, at the second (upper) floor 14, the bracket 18 can be mounted to a joist (J), and can be concealed within the second floor 14, as described in more detail below.

The bracket 18 can be connected to either of the first or second floor at the plate 68 by one or more fasteners extending through the plate 68 and into the floor (e.g. into the SFF). As set forth in further detail below, the fasteners can be e.g. self-tapping, chemical or mechanical anchors, bolted connections, etc. Although not illustrated in FIGS. 5A to 5C, the plate 68 can comprise e.g. four spaced apertures arranged in the plate for receiving the fasteners therethrough.

Referring now to FIGS. 7 to 12, a number of variations of mounting arrangements between the stringer 16 and first and second floors 12,14 are shown and will now be described.

Figure 7:
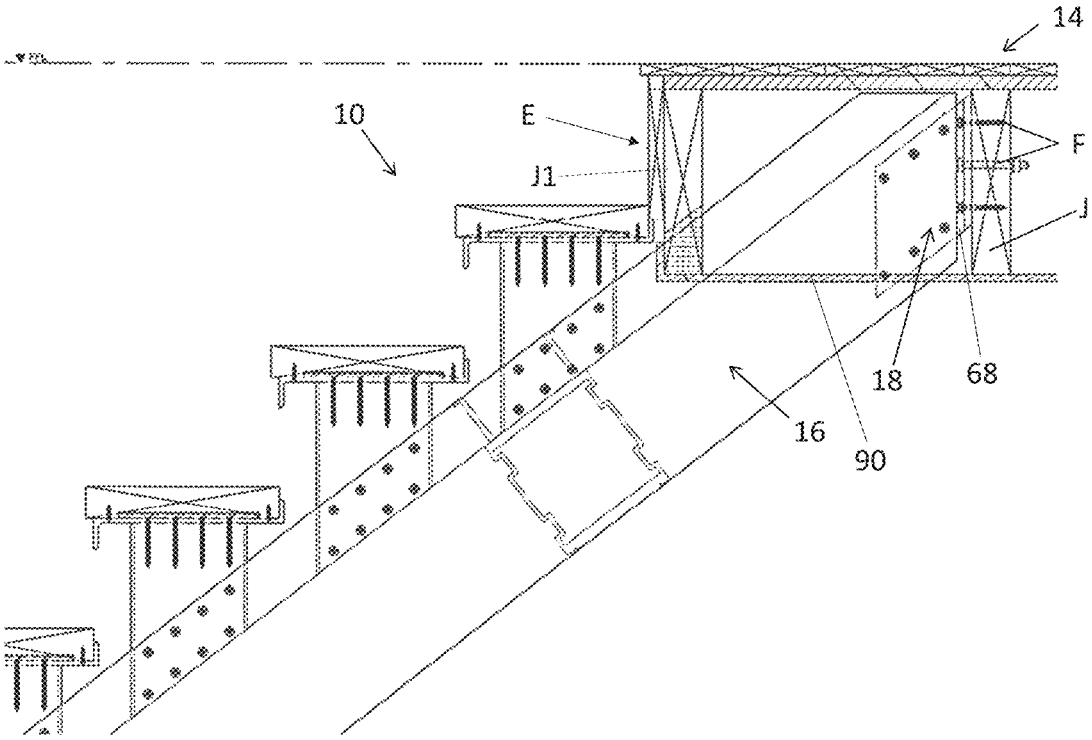
FIG. 7 shows Detail A of FIG. 1, wherein one form of mounting an upper stringer to an overlying floor is shown.
Figure 8:
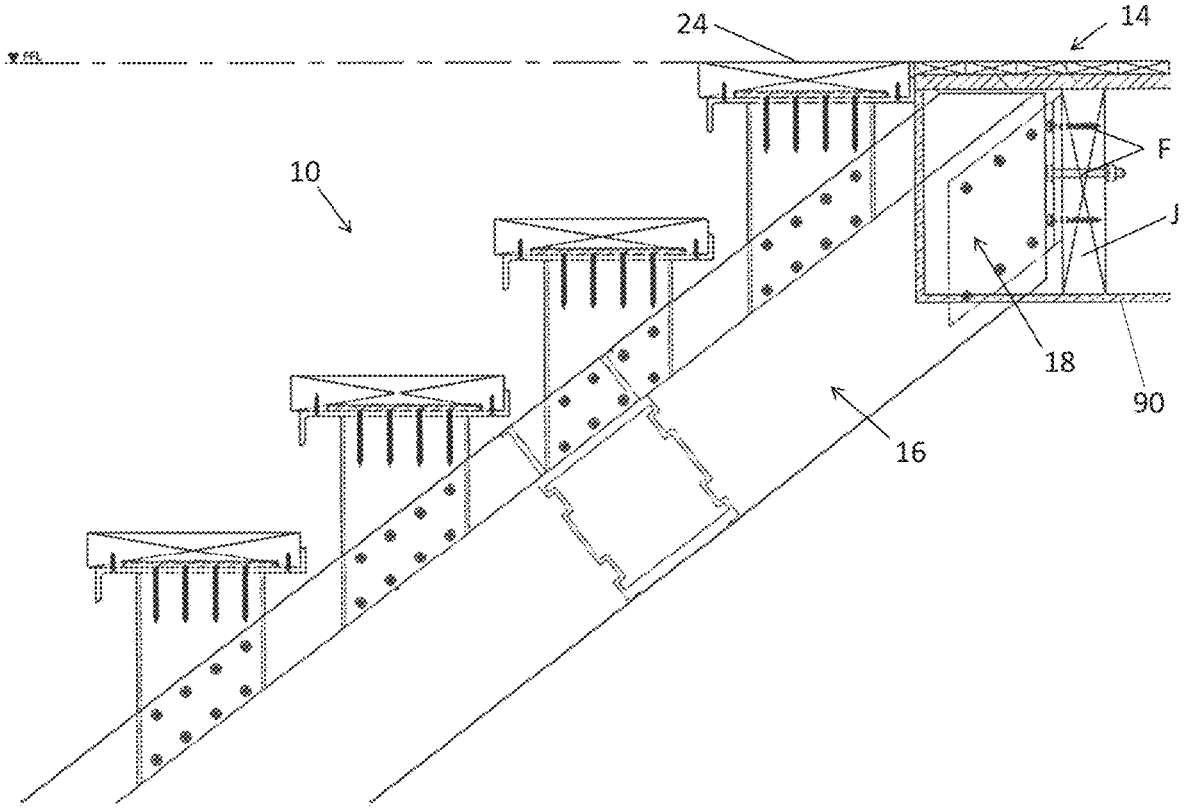
FIG. 8 shows Detail A of FIG. 1, wherein an alternative form of mounting an upper stringer to an overlying floor is shown.
Figure 9:
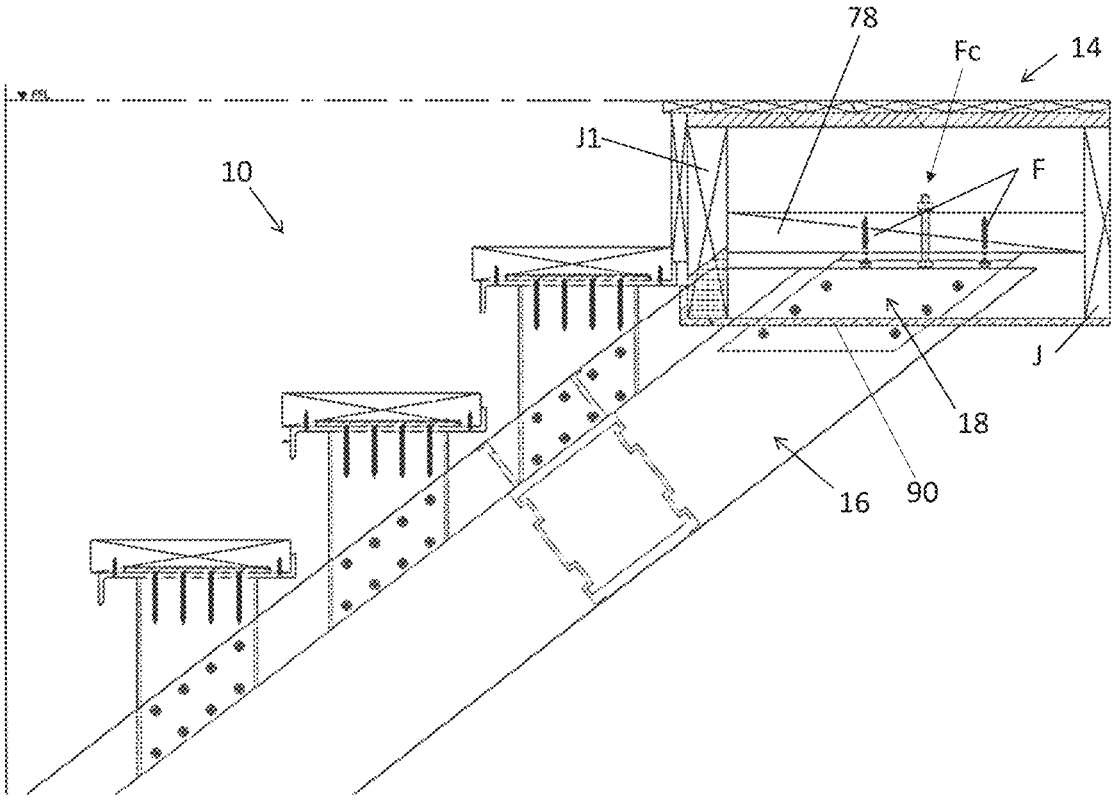
FIG. 9 shows Detail A of FIG. 1, wherein a further alternative form of mounting an upper stringer to an overlying floor is shown.
Figure 10:
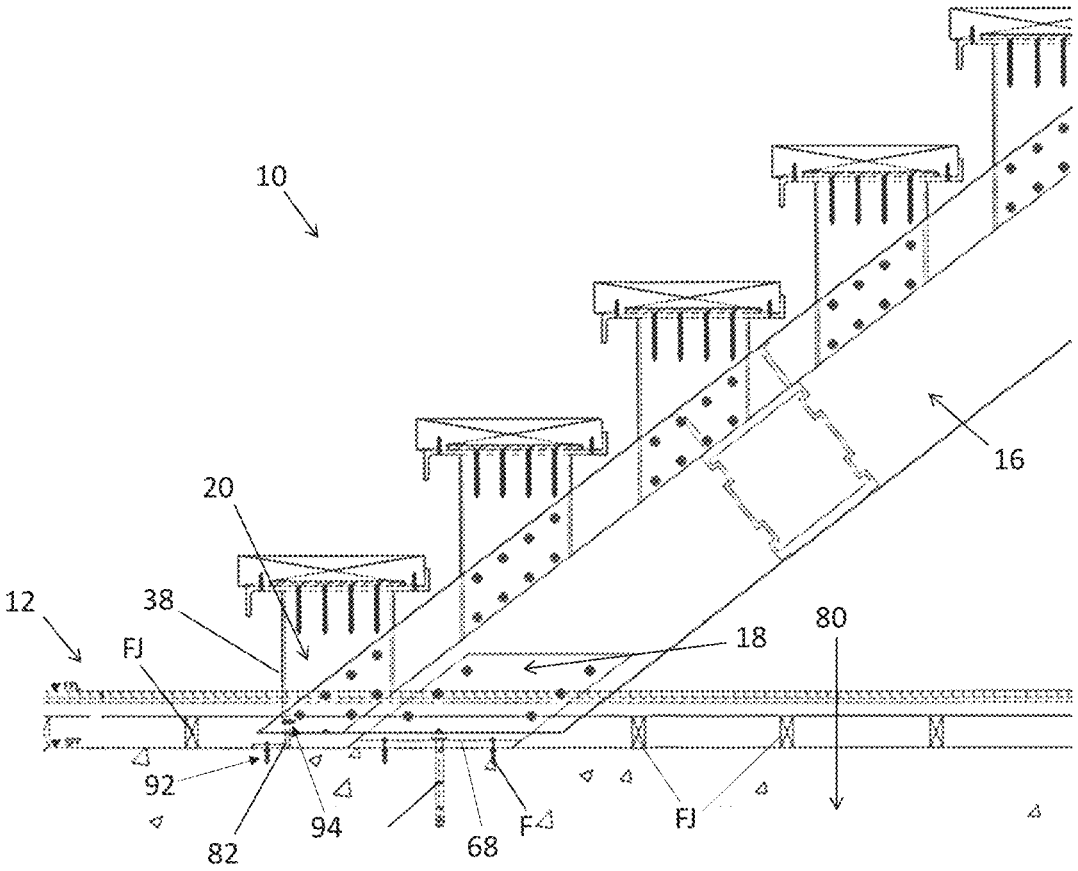
FIG. 10 shows Detail B of FIG. 1, wherein one form of mounting a lower stringer to an underlying floor is shown.
Figure 11:
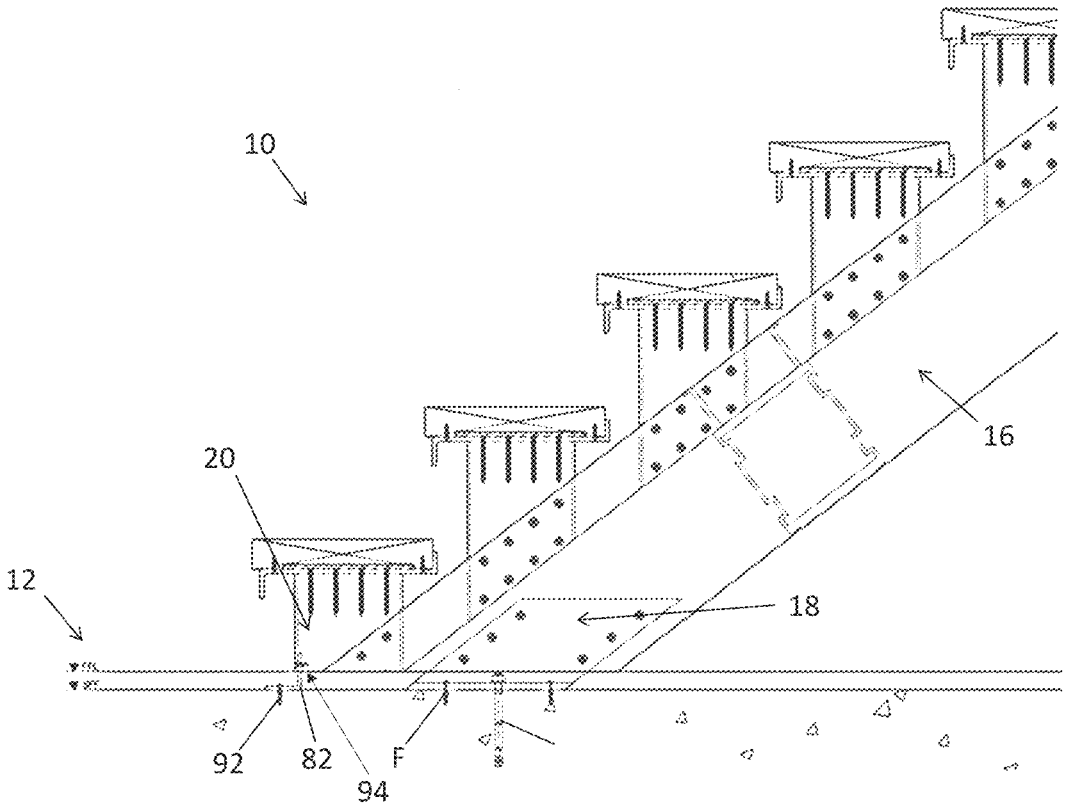
FIG. 11 shows Detail B of FIG. 1, wherein an alternative form of mounting a lower stringer to an underlying floor is shown.
Figure 12:
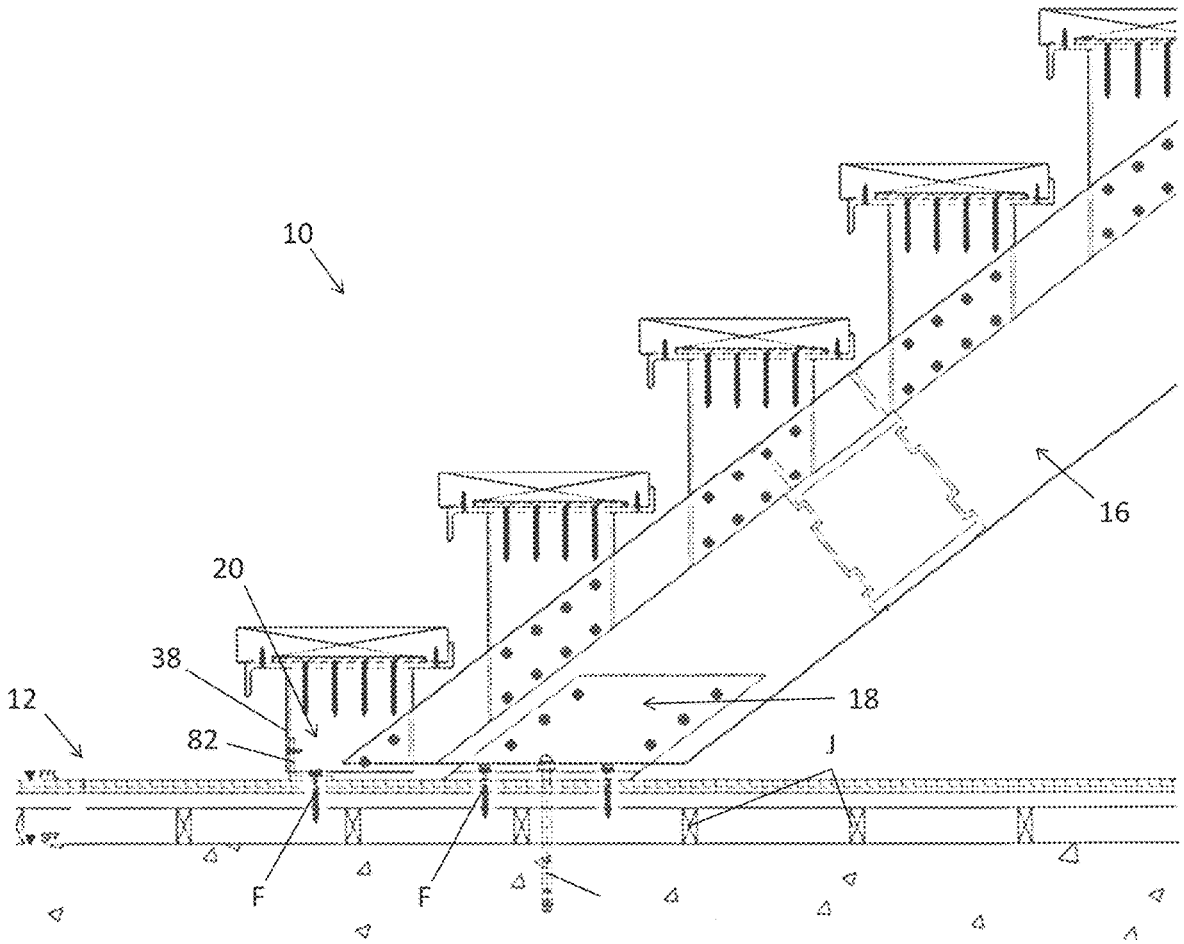
FIG. 12 shows Detail B of FIG. 1, wherein a further alternative form of mounting a lower stringer to an underlying floor is shown.

In particular, FIGS. 7 to 9 show 'Detail A' of FIG. 1, i.e. mounting arrangements of the stringer 16 to a second (or overlying/upper) floor 14 of a structure, and FIGS. 10 to 12 show 'Detail B' of FIG. 1, i.e. mounting arrangements of the stringer 16 to a first (or underlying/lower) floor 12 of a structure.

Referring firstly to FIG. 7, the upper bracket 18 couples the stringer 16 to the joist (J) of the second/overlying floor 14. The plate 68 of bracket 18 is connected to a side face of the joist (J) by e.g. self-tapping screws (F). The joist (J) to which the stringer 16 is coupled can be spaced from an end (E) of the floor 14, such that the upper end of the stringer is able to extend into an underside of the floor 14. For example, and as shown in FIG. 7, the stringer 16 extends at least partially beneath a first joist (J1) located at the end (E) of the overlying floor 14 and mounts to the second joist (J) spaced inwards from the end of the overlying floor. In this way, the first joist (J1) can form at least part of a 'riser' of the staircase 10, with the finished floor level (FFL) of the overlying floor 14 forming the uppermost tread (i.e. the last step) of the staircase. As shown, the bracket 18 can be concealed within the overlying floor 14, such as by arranging a cover plate 90 to mount at an underside of the joists (J).

Referring now to FIG. 8, the stringer 16 is configured such that the bracket 18 mounts to a joist (J) of an overlying floor 14 in a similar way to that shown in FIG. 7. However, the mounting in FIG. 8 differs from FIG. 7 in that the finished floor level (FFL) of the overlying floor is aligned, i.e. flush, with the uppermost tread member 24 of the staircase 10. In this arrangement, the upper end of the stringer 16 is coupled by bracket 18 to the joist (J) positioned towards (not at) an end of the overlying floor such that the stringer 16 extends into the overlying floor from the end of the floor. As such, a surface of the uppermost tread member 24 is continuous with the finished floor level. Again, the bracket 18 can be concealed within the overlying floor 14 by cover plate 90.

Referring now to FIG. 9, the stringer 16 is configured to extend into an underside of the overlying floor in a similar manner to that shown in FIGS. 7 and 8. The mounting in FIG. 9 differs from FIGS. 7 and 8 in that the stringer 16 is mounted by bracket 18 to a stringer landing member 78, e.g. timber blocking, positioned between and connected at its opposing edges to two spaced joists (J, J1). It will be seen that a central fastener (Fc) takes the form of a bolt. The mounting arrangement of FIG. 9 is externally identical in appearance to the arrangement shown in FIG. 7, i.e. a first joist of the overlying floor forms at least part of a 'riser' of the staircase 10 and the finished floor level forms the uppermost tread, i.e. the last step of the staircase. Again, the bracket 18 can be concealed within the overlying floor 14 by cover plate 90.

Referring now to FIG. 10, the bracket 18 is shown coupling the lower end of stringer 16 to the structural floor level (SFF), for example, a concrete footing 80. The plate 68 of bracket 18 can be connected to the structural floor level by e.g. chemical or mechanical anchors (C). In this form, the stringer 16 is arranged to extend through the finished floor level (FFL), whereby the finished floor is shaped/finished to conceal the connection between the stringer 16 and the structural floor level (SFF). In this regard, the finished floor level (FFL) is spaced above the structural floor level (SFF) by lower floor joists (FJ). In some forms, a lowermost of the spigots 20—i.e. at the lower end of the stringer 16—can be additionally supported by an L-bracket 82. The L-bracket 82 can be fastened by anchors 92 to the structural floor level (SFF) and can also be connected to a sidewall 38 of the spigot 20 by e.g. self-tapping screws 94. The L-bracket 82 at least partially supports loading, e.g. bending moments, twisting/torsional forces, etc. acting on the lower most spigot 20.

Referring now to FIG. 11, the bracket 18 couples the stringer 16 to the structural floor level in the same way as shown in FIG. 10, but differs in that the finished floor level (FFL) is located directly on (i.e. not spaced above) so as to overlie the structural floor level (SFF). In other words, the finished floor can be a tiled surface, etc. laid directly onto the structural floor level. In some other forms, the finished floor level can be e.g. a polished concrete, carpet, etc.

Referring now to FIG. 12, the bracket 18 is shown coupling the stringer 16 directly to the finished floor level (FFL), for example, to timber floorboards. The bracket 18 can be connected to the finished floor by e.g. self-tapping screws (F), and additionally, connected to the structural floor level (SFF) by chemical or mechanical anchoring (C). In this form, the spigot 20 can also be configured to adjoin with the finished floor level, i.e. whereby the spigot does not extend through the finished floor level (FFL) to connect with the structural floor level (SFF). As such, the L-bracket 82 is arranged to couple the spigot sidewall 38 directly with the finished floor level via e.g. self-tapping screws (F). As shown, the L-bracket 82 can be arranged internally of the spigot 20 such that the L-bracket is concealed by the spigot, i.e. is not visible in use.

Figure 13:
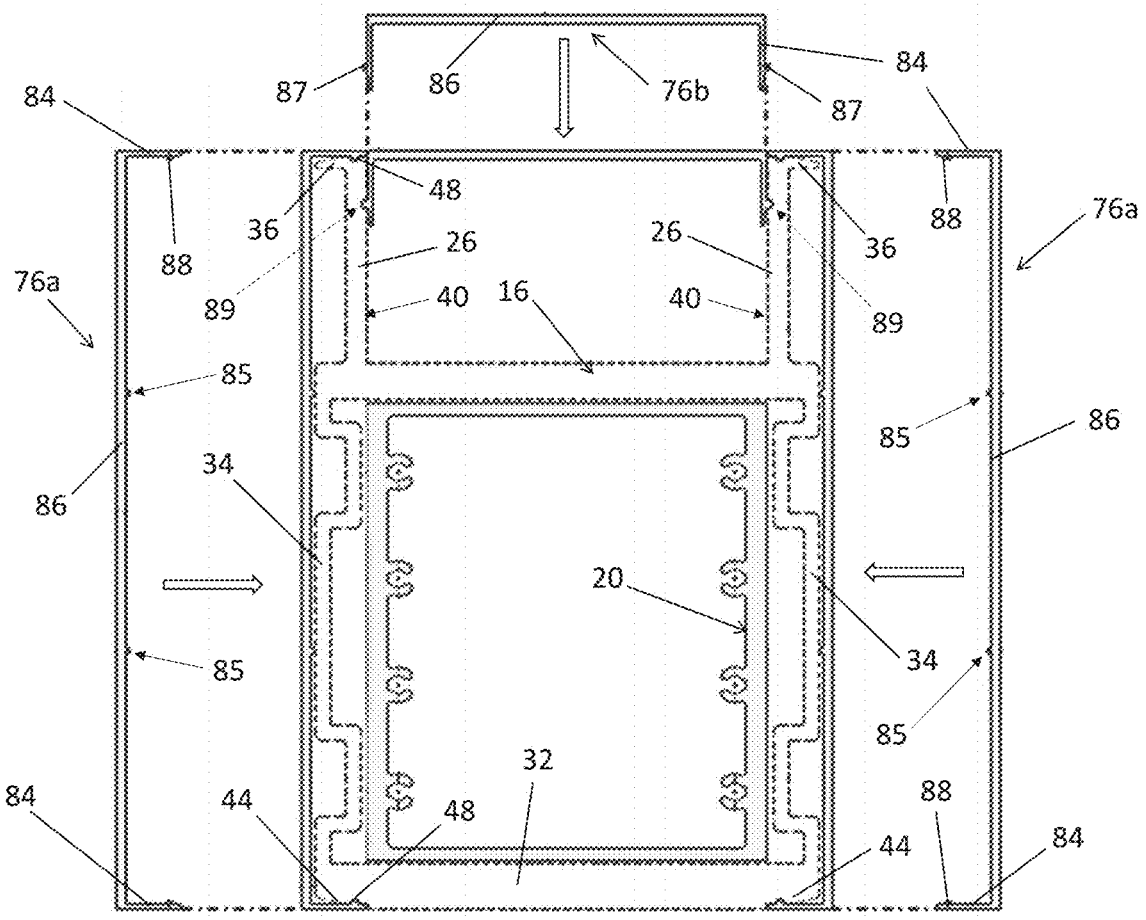
FIG. 13 shows side capping elements and upper capping elements positioned in-line for mounting to, as to cap, a stringer, with phantom lines indicating a path of movement of the capping elements into a mounted position on the stringer.

Referring now to FIG. 13, capping elements are shown in the form of side capping elements 76*a* and upper capping element 76*b*. The capping elements can be provided to enclose respective sidewalls 34 and spaced flanges 26 of the spigot to enhance aesthetics (e.g. give a 'clean-line' appearance). In use, a number of discrete upper capping elements 76*b* are required to be provided to locate between adjacent upstanding spigot pairs 20, although FIG. 13 only shows one such upper capping element 76*b*. Each of the side and upper capping elements 76*a*,76*b* are described below in further detail.

Side capping elements 76*a* comprise first and second lips 84 extending along and from opposite edges of a long side 86. As shown by phantom lines in FIG. 13, the first and second lips 84 are configured to connect with the lips 36 (of the flanges 26) and the recesses 44 (of the lower wall 32). As such, the first and second lips 84 comprise protrusions 88 configured to engage with corresponding notches 48 provided in lips 36 and recesses 44. The corresponding lips 36,84 can 'snap-engage' to retain the side capping element 76*a* to the stringer 16.

The inside face of long side 86 of each side capping element 76*a* also comprises bumps 85 which interface with the sidewalls 34 of the stringer 16 to space each long side 86 from its respective sidewall 34.

The side capping elements 76*a* are configured to extend a length of the stringer 16 when mounted thereto, such that fasteners (F) connected at the grooves 42 and flanges 26 (in an assembled staircase) are covered/concealed by the side capping elements 76*a*. Advantageously, the side capping elements 76*a* can be snap-fitted at the end of assembly—i.e. to a finished modular staircase, and can even allow the capped stringer to be e.g. painted (if required). Alternatively, the side capping elements can have surface finishes, e.g. wood grain, anodized, coated, painted with a matt or gloss finish, etc. Such surface finishes can be provided to suit a particular style of the staircase and building.

Upper capping element 76*b* is generally shaped in the same way as the side capping elements 76*a* and, as shown by phantom lines in FIG. 13, is configured to engage corresponding internal notches 89 defined in the inside walls 40 of flanges 26. In this regard, the first and second lips 84 of upper capping element 76*b* comprise externally located protrusions 87 that are configured to snap-engage with the corresponding internal notches 89.

The upper capping element 76*b* also differs from the side capping elements 76*a* in that the long side 86 of the upper capping elements is shorter in width (i.e. when viewed in profile) so as to extend between the inside of the flanges 26. Further, the upper capping element 76*b* is located between the opposingly (i.e. inwardly) facing walls 40 (best shown in FIG. 3A) of the two flanges 26, whereas the side capping elements 76*a* locate 'outside' the stringer 16, being configured to engage with outwardly facing recesses 44 on the flanges 26 and lower wall 32 of the stringer.

The upper capping element 76*b* is configured to conceal the space between the flanges 26 such that, when the side capping elements 76*a* are also mounted to the stringer, the stringer appears as a rectangular-section beam. In other words, the upper and side capping elements together conceal the corrugations/deviations, e.g. grooves 42, etc. in the sides of the stringer 16.

As above, the upper capping elements 76*b*, when mounted in-use between flanges 26, can each be sized to extend between adjacent, spaced-apart spigot pairs 20. In other words, the upper capping elements interspace the spigots to enclose the space between adjacent spigots 20 and between the flanges 26. The upper capping elements can be cut-to-measure (e.g. onsite or prefabricated) according to the spacing that has been provided between the spigots 20.

In a similar way to the side capping elements 76*a*, the upper capping elements 76*b* can also be provided with various surface finishes (e.g. wood grain, anodized, coated, painted with a matt or gloss finish, etc.) to suit a particular style of the staircase and building.

Each of the side and upper capping elements 76*a*,76*b* can be pre-connected to respective sidewalls 34 and flanges 26 when packaging the components of the modular staircase for transport to a building site. Advantageously, this can simplify packaging such that each of the side and upper capping elements and the stringer do not need to be packaged separately. Furthermore, when supplied in their mounted positions, the side and upper capping elements are less prone to damage, e.g. by bending, because they are 'structurally retained' by the stringer.

For example, when upper capping element 76*b* is positioned between the flanges 26, the upper capping element can support the flanges when, e.g. the flanges are knocked or impacted during transport. That is, if one or both of the flanges 26 is forced inwardly during transport, the upper capping element 76*a* can help prevent the one or both flanges from deflecting, i.e. bending, inwardly as a result of the applied force.

Furthermore, and as also shown in FIG. 13, the spigot 20 can be inserted within (i.e. slid endwise into) the stringer body 29 for the purposes of packaging to transport the modular staircase to a building site. In this case, the spigot 20 can be provided uncut, i.e. as an extruded long length. This long length may be fully inserted into and extend through the stringer body 29 to be stably retained during e.g. transport. When removed from the stringer body 29, the extruded length of each spigot 20 can be cut-to-measure, according to the required 'riser' length.

Advantageously, transporting each of the stringer 16, spigot 20, upper and side capping elements 76*a*,76*b* in a connected, structurally supported arrangement can protect each of the components from damage. Furthermore, connecting each of the abovementioned components together during transport can minimise the amount of volume and of packaging that would otherwise be required to transport each of the components alone, i.e. separately.

Variations and modifications may be made to the parts previously described without departing from the spirit or ambit of the disclosure.

For example, handrails can be provided for use with the modular staircase as set forth above. The handrails can be modular, and therefore comprise modular components including balusters, newel post, etc. which can be cut-to-measure according to the design requirements of the staircase.

In another example, the modular staircase can be provided with a skirting board, i.e. a spandrel wall, for concealing a space beneath the modular staircase.

In further example, the stringer may be curved for e.g. a spiral-type staircase. In this form, correspondingly shaped capping elements can be provided for mounting to the curved stringer.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the modular staircase.

What is claimed is:

1. A modular staircase suitable for use in a structure, the modular staircase comprising:

at least one stringer having an elongate axis, the stringer configured for extending between a first floor of the structure and a second floor of the structure, the stringer having a box-section profile and at least two flanges projecting from a first wall of the stringer profile;

at least one spigot configured for mounting between the at least two flanges such that an axis of the spigot is able to extend at an angle with respect to the stringer elongate axis, the spigot able to be fastened between the flanges by respective fasteners that extend through the flanges and corresponding walls of the spigot; and at least one tread support for coupling to the stringer via the at least one spigot, wherein when the angle of the spigot axis is adjusted relative to the stringer elongate axis, the tread support is able to be orientated at an angle relative to the stringer in-use.

2. A modular staircase according to claim 1, wherein the at least one spigot comprises a box-section profile, with one side wall of the box-section profile able to locate in adjacency of and/or to abut one of the at least two flanges, and with an opposing side wall of the box-section profile able to locate in adjacency of and/or to abut another one of the at least two flanges.

3. A modular staircase according to claim 2, wherein an internal surface of at least one of the walls of the spigot box-section profile is provided with one or more fastener retention formations, each formation configured to fasteningly receive a respective fastener therein, the respective fastener extending from and through the tread support to fasten the tread support to the spigot and thereby couple the tread support to the stringer.

4. A modular staircase according to claim 1, wherein an end of the at least one spigot that is mounted between the at least two flanges is configured to be cut at an angle such that, when the spigot is mounted at the stringer, the angle of the cut is generally parallel to the stringer elongate axis, such that the spigot axis extends generally vertically in use.

5. A modular staircase according to claim 1, wherein the at least one tread support comprises an elongate plate, with opposing flanges extending along respective long sides of the elongate plate, a front such flange arranged to project downwards in use and a rear such flange arranged to project upwards in use, whereby the tread support has a generally S-shaped profile.

6. A modular staircase according to claim 1, the staircase further comprising at least two brackets, each bracket for mounting to the at least one stringer at a respective in-use lower or upper end thereof, each bracket configured to connect its respective lower or upper stringer end to the respective first and second floors of the structure, each of the at least two brackets comprising:

a floor-mounting portion for connecting the bracket to the first or second floor of the structure respectively; and a stringer-mounting portion for connecting the bracket to the lower or upper stringer end respectively.

7. A modular staircase according to claim 6, wherein:

the floor-mounting portion of each bracket comprises a plate, the plate configured to have one or more fasteners extend therethrough to secure the plate to the first or second floor of the structure respectively; and the stringer-mounting portion of each bracket comprises first and second spaced flanges, each flange configured for location adjacent to a respective side wall at a respective end of the stringer box-section profile such that each flange is able to be fastened to its adjacent respective wall in use.

8. A modular staircase according to claim 7, wherein the first and second flanges are spaced for insertion into an open end of the stringer box-section profile such that, when inserted, each flange locates adjacent to its respective side wall in use.

9. A modular staircase according to claim 6, wherein opposing in-use side walls of the at least one elongate stringer each have two spaced parallel elongate grooves defined therein, the grooves running for the length of the side wall, each of the two stringer grooves configured in use to have one or more fasteners extend therethrough and into fastening engagement with a respective one of the first and second flanges to secure a respective end of the stringer to the bracket, and to thereby secure the respective end of the stringer to the first or second floor of the structure respectively.

10. A modular staircase according to claim 1, the staircase further comprising at least one tread member configured to locate at and be supported at a respective tread support, the at least one tread member and tread support each arranged to extend laterally from and transverse to the stringer in use.

11. A modular staircase according to claim 10, the staircase further comprising at least one stiffener plate configured to locate at and be supported at a respective tread support, the stiffener plate and tread support each arranged to extend laterally from and transverse to the stringer in use, the stiffener plate is located in use between the tread member and the tread support.

12. A modular staircase according to claim 1, the staircase further comprising elongate capping elements, each capping element configured for mounting to, to at least partially conceal, a respective adjacent surface of the stringer, the elongate capping elements each configured for mounting to and along respective side walls of the stringer, each capping element comprising:

a first lip that extends along and projects inwardly from a long side of the capping element, the first lip configured to interact with a respective one of the at least two flanges that projects from the first wall of the stringer; and a second lip that extends along and projects inwardly from an opposite long side of the capping element, the second lip configured to interact with an opposite second wall of the stringer, wherein the lips are configured to retain the elongate capping elements to a respective side wall of the stringer.

13. A modular staircase according to claim 12, wherein a second single elongate capping element is configured for mounting to and along the first wall of the stringer, the second single capping element comprising:

a first lip that extends along and projects inwardly from one long side of the single capping element, the first lip configured to interact with a respective one of the at least two flanges that projects from the first wall of the stringer; and a second lip that extends along and projects inwardly from an opposite long side of the single capping element, the second lip configured to interact with a respective other of the at least two flanges that projects from the first wall of the stringer, wherein the lips are configured to retain the single capping element to the two flanges and thereby to the first wall of the stringer.

14. A modular staircase according to claim 1, wherein the staircase comprises two spaced parallel stringers.

15. A method for constructing a staircase for a structure, the method comprising:

mounting an in-use lower end of the at least one stringer as defined in claim 1 with respect to a first floor of the structure;

mounting an in-use upper end of the at least one stringer as defined in claim 1 with respect to a second floor of the structure; and mounting a plurality of spigots and respective tread supports, as defined in claim 1, in a spaced relationship along length of the stringer to enable a plurality of tread members to be mounted to the staircase.

16. A modular staircase suitable for use in a structure, the staircase comprising:

at least one stringer having an elongate axis, the stringer configured for extending between a first floor of the structure and a second floor of the structure, the stringer having a box-section profile and at least two flanges projecting from a first wall of the stringer profile;

at least one spigot configured as a box-section profile for mounting with the at least two flanges, wherein one side wall of the box-section profile able to locate in adjacency of and/or to abut one of the at least two flanges, and with an opposing side wall of the box-section profile able to locate in adjacency of and/or to abut another one of the at least two flanges, and such that an axis of the spigot is able to extend at an angle with respect to the stringer elongate axis; and at least one tread support for coupling to the stringer via the at least one spigot, wherein when the angle of the spigot axis is adjusted relative to the stringer elongate axis, the tread support is able to be orientated at an angle relative to the stringer in-use.

* * * * *